US008635932B2

(12) United States Patent
Chen

(10) Patent No.: US 8,635,932 B2
(45) Date of Patent: Jan. 28, 2014

(54) EASY ASSEMBLED RATCHET WRENCH

(76) Inventor: Shu-Ju Chen, Taichung (TW)

( * ) Notice: Subject to any disclaimer, the term of this patent is extended or adjusted under 35 U.S.C. 154(b) by 376 days.

(21) Appl. No.: 12/984,611

(22) Filed: Jan. 5, 2011

(65) Prior Publication Data

US 2012/0167722 A1 Jul. 5, 2012

(51) Int. Cl.
*B25B 13/46* (2006.01)

(52) U.S. Cl.
USPC ..... 81/63; 81/63.2; 81/63.1

(58) Field of Classification Search
USPC ..... 81/58–63.2
See application file for complete search history.

(56) References Cited

U.S. PATENT DOCUMENTS 7,146,882 B1 * 12/2006 Chang ..... 81/63.2
2012/0060653 A1 * 3/2012 Hsu ..... 81/63.1

* cited by examiner

*Primary Examiner* — Monica Carter
*Assistant Examiner* — Melanie Alexander
(74) *Attorney, Agent, or Firm* — Raymond Y. Chan; David and Raymond Patent Firm

(57) ABSTRACT

An easy assembled ratchet wrench contains a body including a head portion disposed on at least one end thereof, the head portion including a first chamber and a second chamber, the first chamber including a recess; a ratchet member received in the first chamber and including plural first teeth and at least one tool end; an engaging member placed in the second chamber and including plural second teeth; a direction controlling member inserted into the engaging member to push the engaging member and including a contacting face; a fitting member fixed in the first chamber and including the guiding face so that the guiding face guides the direction controlling member to displace horizontally and including an indent fixed on an outer wall thereof; a C-shaped retainer retained in the indent of the fitting member and the recess of the body to position the fitting member.

8 Claims, 10 Drawing Sheets

EASY ASSEMBLED RATCHET WRENCH

BACKGROUND OF THE PRESENT INVENTION

1. Field of Invention

The present invention relates to an easy assembled ratchet wrench.

2. Description of Related Arts

Referring to FIG. 1, a conventional ratchet wrench disclosed in TW Pat. No. M 286098 includes a handle 11, a driving member 12, a paw member 13, a fitting member 14, an engaging member 15, and an actuating member 16, wherein the handle 11 includes a head portion 111 with a through hole 112 and a chamber 113, the through hole 112 includes a groove 114 formed therein, and the chamber 113 includes a receiving bore 115 disposed therein to receive a spring 116 and a column 117, the head portion 111 includes a receiving segment 118 fixed on a top end thereof in response to the chamber 113, the driving member 12 includes a first toothed portion 121 formed on an outer surface thereof and a polygonal orifice 122 arranged therein and is fixed in the through hole 112 of the handle 11, the paw member 13 includes an aperture 131, a second toothed portion 132 fixed on one surface thereof in response to the driving member 12, and two recessed portions 133 disposed on another surface thereof in response to the column 117 to be abutted against by the column 117, the fitting member 14 includes a notch 11 secured on an outer surface thereof to receive the engaging member 15 with a mouth 151, the actuating member 16 includes a first end 161 and a second end 162, and the first end 161 includes an extending protrusion 163 having a stopping tab 164 to correspond to the fitting member 14, the extending protrusion 163 is retained in an indent 141 of the fitting member 14, and the fitting member 14 and the actuating member 16 are connected with the handle 11 so that the fitting member 14 is retained in the groove 114 of the through hole 112 by using the engaging member 15, the second end 162 of the actuating member 16 is inserted into the aperture 131 of the paw member 13 to control the second toothed portion 132 to engage with the first toothed portion of the driving member 12, thus connecting the ratchet wrench together. However, such a conventional ratchet wrench has the following disadvantages:

1. The extending protrusion 163 of the actuating member 16 is retained in the indent 141 of the fitting member 14, therefore the mouth 151 of the engaging member 15 has to face to the actuating member 16 so that a predetermined space is kept in the indent 141 to retain the extending protrusion 163, if the mouth 151 can not face to the actuating member 16, the extending protrusion 163 of the actuating member 16 is not retained in the indent 141 of the fitting member 14, the mouth 151 of the engaging member 15 has to be adjusted, connecting the engaging member 15 troublesomely.

2. The extending protrusion 163 of the actuating member 16 is fixed on the first end 161 and is retained in the indent 141 of the fitting member 14 so as to displace along the indent 141 to actuate the paw member 13 to operate, accordingly the actuating member 16 is produced complicatedly to increase production cost.

3. The extending protrusion 163 of the actuating member 16 displaces along the indent 141, so a thickness of the extending protrusion 163 and a width of the fitting member 14 have to be made precisely, having a complicate manufacture process.

4. The second end 162 of the actuating member 16 is inserted into the aperture 131 of the paw member 13, accordingly the extending protrusion 163 has to be retained in the indent 141, and the actuating member 16 is connected with the fitting member 14 so that the second end 162 is inserted into the aperture 131 of the paw member 13 well, but during connecting the fitting member 14 with the actuating member 16 together, the engaging member 15 has to be pressed to prevent from disengagement, having a connecting process.

The present invention has arisen to mitigate and/or obviate the afore-described disadvantages.

SUMMARY OF THE PRESENT INVENTION

The primary object of the present invention is to provide an easy assembled ratchet wrench that after the ratchet member and the engaging member of the body are fixed by using the fitting member, the guiding face is used to guide the direction controlling member to displace horizontally without providing an extending protrusion having a stopping tab on the direction controlling member to simplify manufacture process.

The secondary object of the present invention is to provide an easy assembled ratchet wrench that the C-shaped retainer is fixed easily to assemble the ratchet wrench easily as well.

Further object of the present invention is to provide an easy assembled ratchet wrench of which a guiding face of the fitting member is flat to slide the direction controlling member horizontally along the guiding face without using the direction controlling member with a precise thickness and an indent with a precise width, thus simplifying manufacture process.

Another object of the present invention is to provide an easy assembled ratchet wrench that the direction controlling member slides along the guiding face horizontally without retaining the fitting member and the direction controlling member together to assemble the ratchet wrench easily.

In accordance with the present invention, there is provided an easy assembled ratchet wrench which contains:

a body including a head portion disposed on at least one end thereof, and the head portion including a first chamber and a second chamber, the first chamber including a recess formed around an inner wall thereof;

a ratchet member received in the first chamber of the body and including a plurality of first teeth arranged around an outer wall thereof and at least one tool end;

an engaging member placed in the second chamber of the body and including a number of second teeth fixed on one surface thereof in response to the first teeth of the ratchet member;

a direction controlling member inserted into the engaging member to push the engaging member and including a contacting face fixed on one side surface thereof;

a fitting member fixed in the first chamber of the body and including a guiding face formed on one side thereof in response to the contacting face of the direction controlling member so that the guiding face guides the direction controlling member to displace horizontally and including an indent fixed on an outer wall thereof;

a retaining element retained in the indent of the fitting member and the recess of the body to position the fitting member.

DETAILED DESCRIPTION OF THE PREFERRED EMBODIMENT

Figure 1:
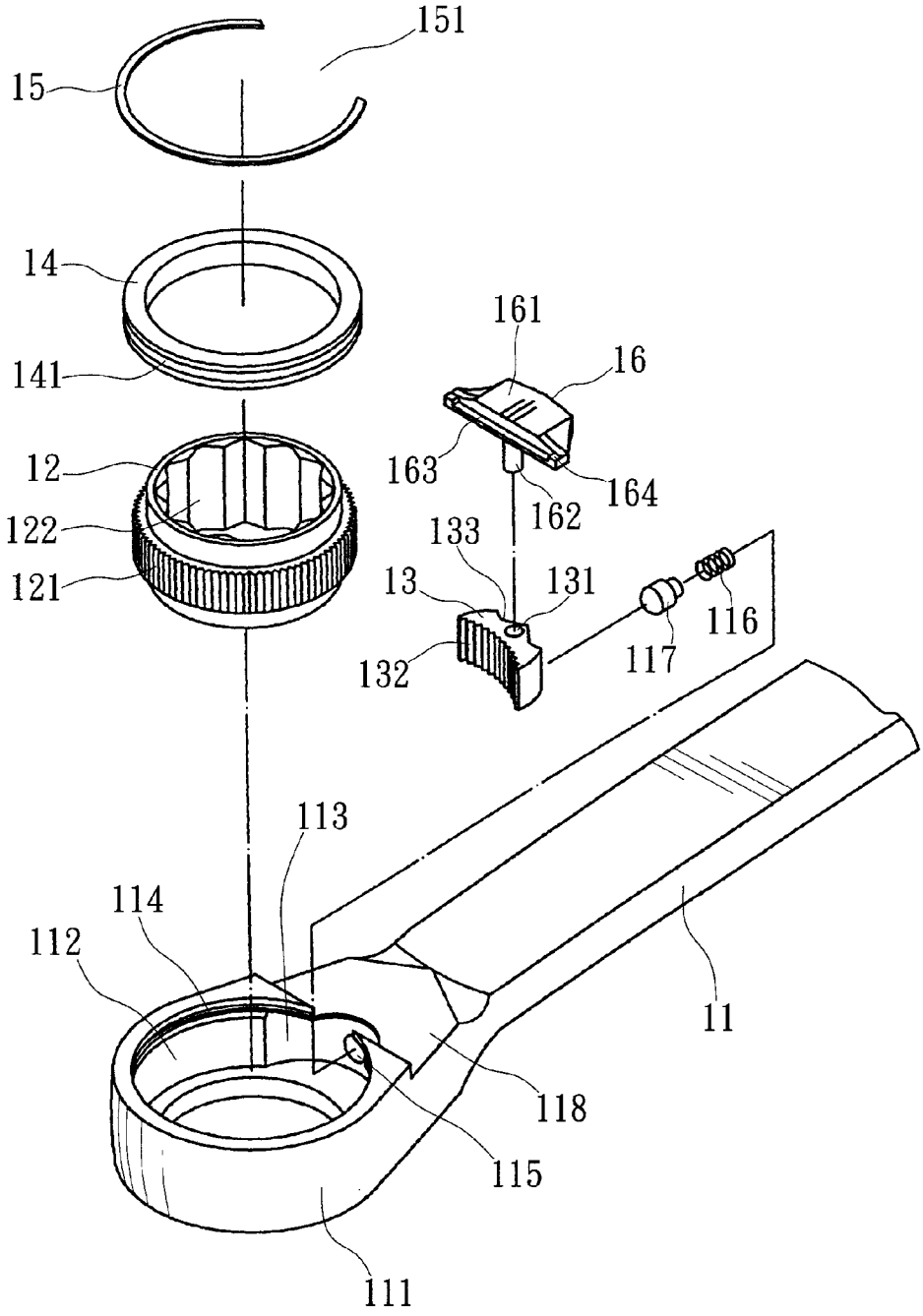
F I G . 1 PRIOR ART
FIG. 1 is a perspective view of a conventional ratchet wrench disclosed in TW Pat. No. M 286089.
Figure 2:
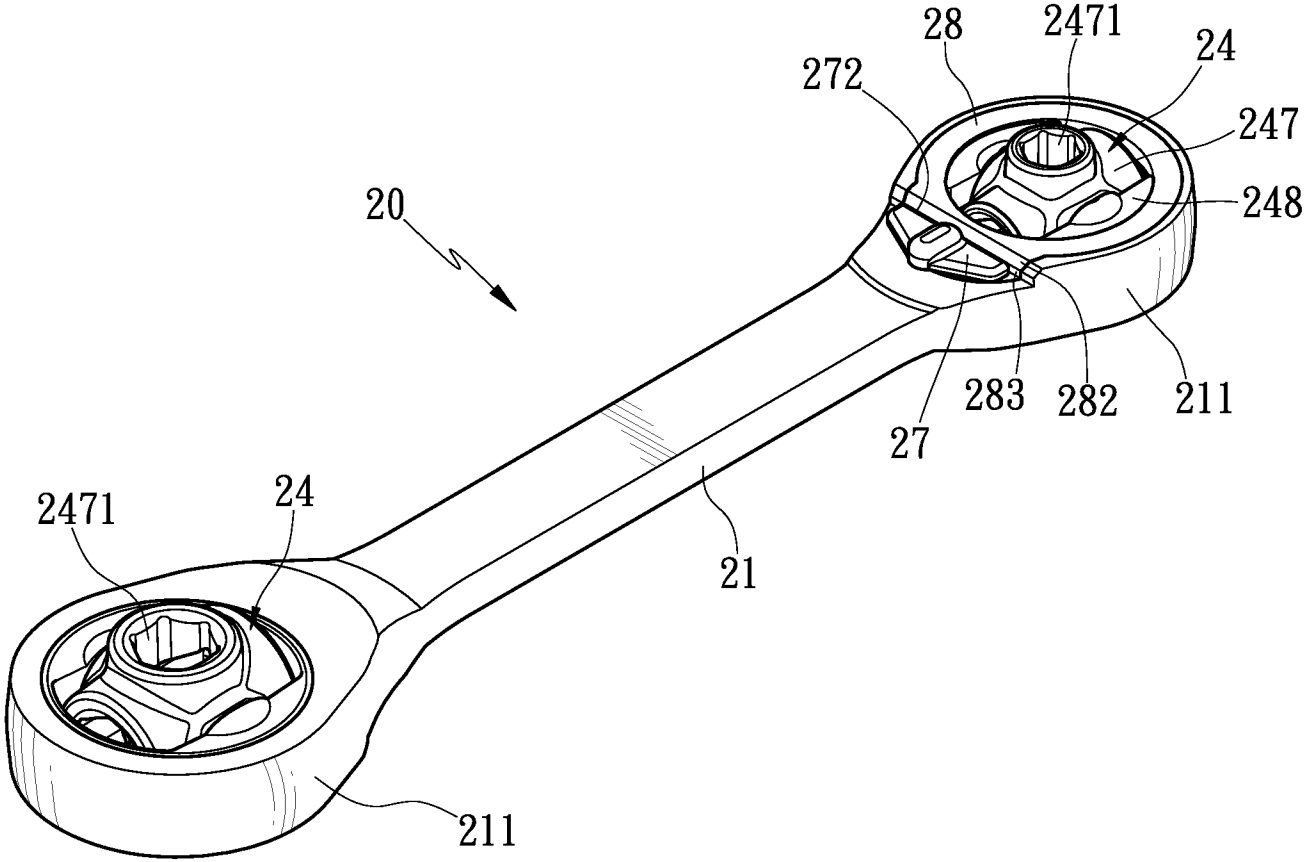
FIG. 2 is a perspective view showing the assembly of an easy assembled ratchet wrench according to a first embodiment of the present invention.
Figure 3:
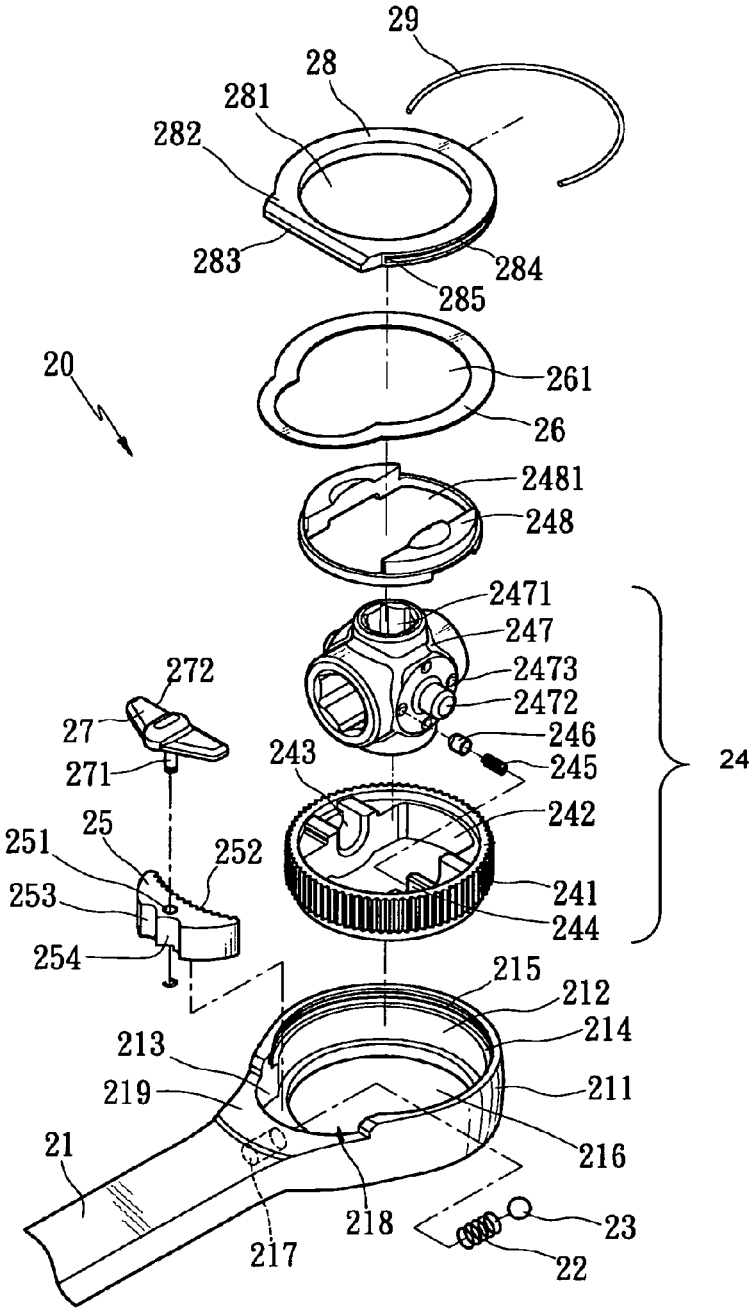
FIG. 3 is a perspective view showing the exploded components of the easy assembled ratchet wrench according to the first embodiment of the present invention.
Figure 4:
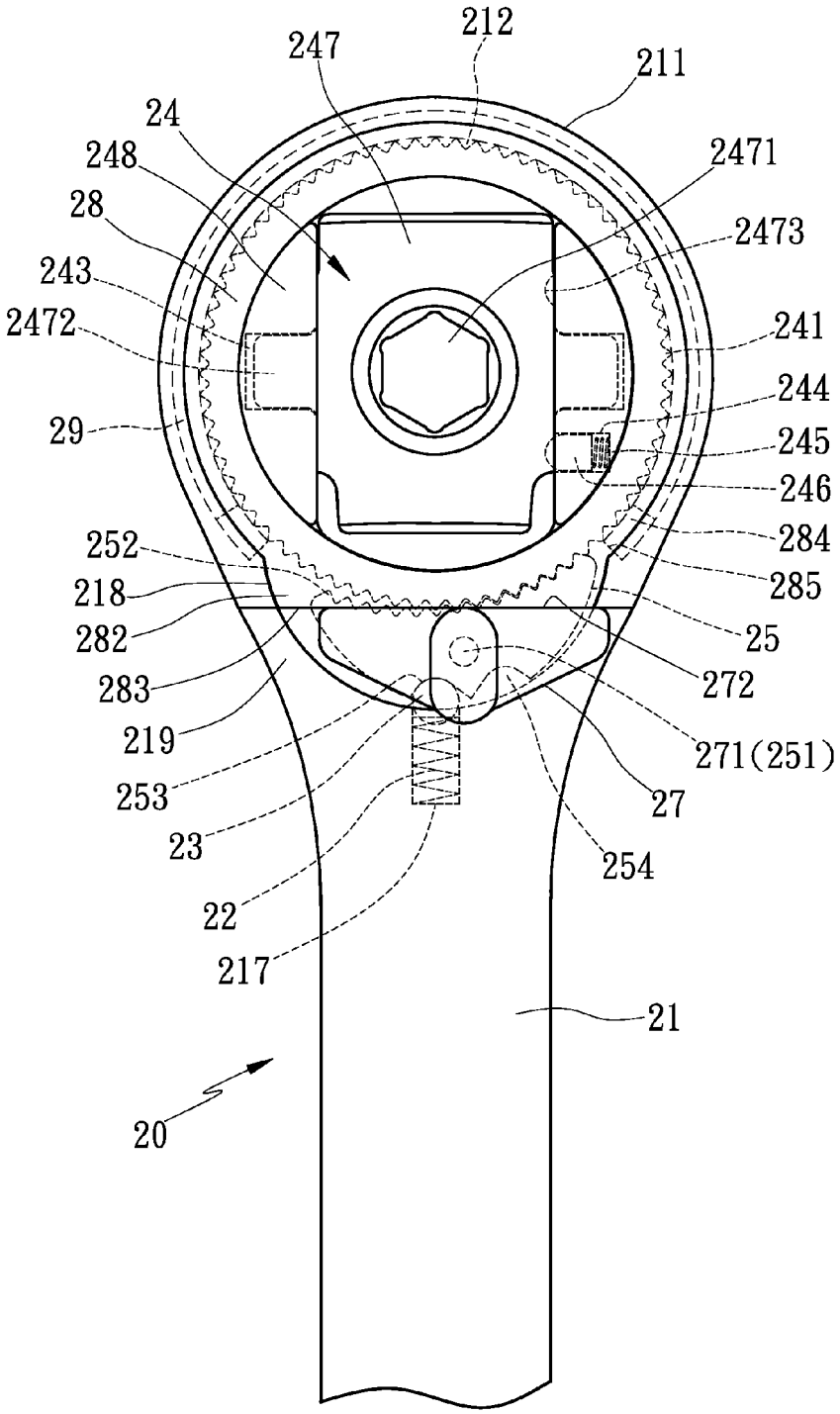
FIG. 4 is a cross sectional view showing the assembly of the easy assembled ratchet wrench according to the first embodiment of the present invention.
Figure 5:
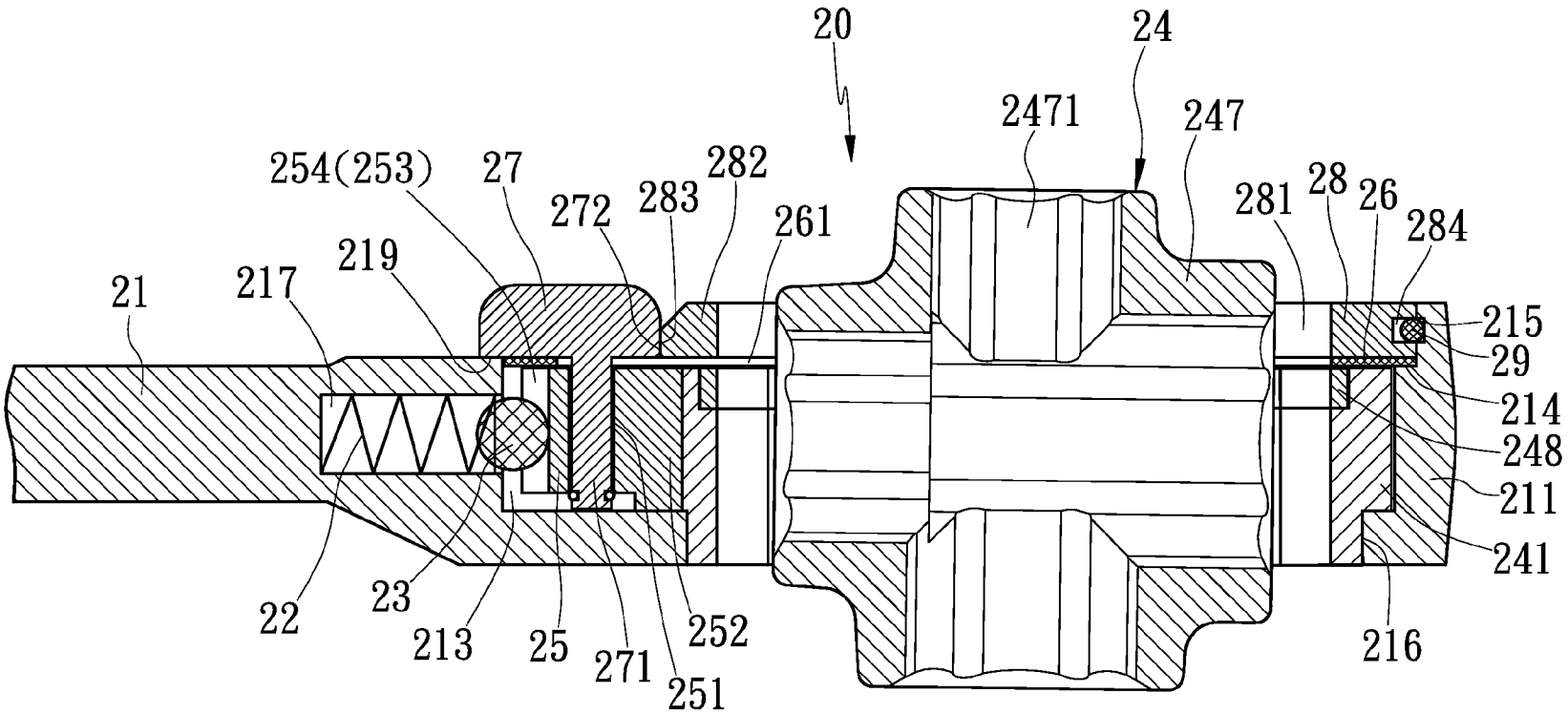
FIG. 5 is another cross sectional view showing the assembly of the easy assembled ratchet wrench according to the first embodiment of the present invention.

Referring to FIGS. 2-5, an easy assembled ratchet wrench 20 in accordance with a first embodiment of the present invention comprises: a body 21 including a head portion 211 disposed on at least one end thereof, wherein there are two head portions 211 provided on two ends of the body 21 respectively in this embodiment, and each head portion 211 includes a first chamber 212 and a second chamber 213 communicating with the first chamber 212, the first chamber 212 includes a stepped shoulder 214 fixed adjacent to a top end of an inner wall thereof, and the stepped shoulder 214 includes a recess 215 formed around an inner wall thereof, a bottom end of the first chamber 212 is a flat surface or includes a through hole formed thereon, wherein the first chamber 212 includes a port 216 formed on the bottom end thereof, and the second chamber 213 includes an aperture 217 arranged on an inner wall thereof to receive a first resilient element and an abutting element, wherein the resilient element is a first spring 22 and the abutting element is a steel ball 23 in this embodiment, the head portion 211 of the body 21 includes a cutout 218 and a receiving segment 219 disposed on a top surface thereof in response to the second chamber 213, and a ratchet member 24 is received in the first chamber 212 of the head portion 211 and includes a plurality of first teeth 241 arranged around an outer wall thereof, a groove 242 fixed therein, two axial seats 243 formed on two sides of the groove 242 individually, and a notch 244 fixed on one side of the groove 242 to receive a second resilient element and a positioning element, wherein the second resilient element is a second spring 245 and the positioning element is a pushing post 246, the groove 242 of the ratchet member 24 is provided to receive a rotating block 247 having at least one tool end 2471, wherein the rotating block 247 is a bit, a polygonal bore of a bolt, or a polygonal column of a socket, the rotating block 247 of the ratchet member 24 includes four tool ends 2471 with different sizes in this embodiment, and each tool end 2471 is the polygonal bore of the bolt in this embodiment, the ratchet member 24 also includes an axial shaft 2472 disposed on two sides thereof and a holder 243 fixed thereon so that the rotating block 247 rotates in the ratchet member 24 and change the tool end 2471, and the rotating block 247 includes a plurality of cuts 2472 secured on one side surface thereof in response to the pushing post 246 of the ratchet member 24, and one of the cut 2472 is provided to retain the pushing post 246 so that the rotating block 247 is positioned, the rotating block 247 also includes a cover 248 disposed on a top end of the ratchet member 24 and having an aperture 2481, and the tool end 2471 of the rotating block 247 extends out of the aperture 2481 so that the rotating block 247 is fixed in the ratchet member 24, and the ratchet member 24 is further placed in the first chamber 212 of the body 21, one of the tool ends 2471 extends out of the port 216 of the body 21, because each head portion 211 of the body 21 includes one ratchet member 24, the ratchet wrench 20 includes eight tool ends 2471 with different sizes individually and each with one polygonal bore, an engaging member 25 includes a first orifice 251, a number of second teeth 252 fixed on one surface thereof in response to the first teeth 241 of the ratchet member 24, and a first fixing portion 253 and a second fixing portion 254 attached on two sides of another surface thereof, the engaging member 25 is placed in the second chamber 213 of the body 21 so that the first fixing portion 253 is abutted against by the steel ball 23 and the second teeth 252 of the engaging member 25 engage with the first teeth 241 of the ratchet member 24, a limiting member 26 includes an opening 261 and is fixed on the stepped shoulder 214 of the body 21 to limit the ratchet member 24 and the engaging member 25, a direction controlling member 27 includes a stem 271 disposed on a bottom end thereof and a contacting face 272 fixed on one side surface thereof, the contacting face 272 is a flat surface in this embodiment, and the direction controlling member 27 is inserted into the first orifice 251 of the engaging member 25 and is placed on the receiving segment 219 of the body 21 so that the direction controlling member 27 is used to control the engaging member 25 to engage with the ratchet member 24, and a fitting member 28 includes a second orifice 281 and a guiding face disposed on one side thereof in response to the contacting face 272 of the direction controlling member 27, wherein the fitting member 28 includes the guiding face 283 with a projection 282 formed on the one side thereof in response to the contacting face 272 of the direction controlling member 27 in this embodiment, the guiding face 283 is flat, and the fitting member 28 also includes an indent 284 fixed on an outer wall thereof, the indent 284 includes two stop faces 285 attached on two ends thereof respectively and is used to retain a retaining element, such as a C-shaped retainer 29, the stop faces 285 is provided to limit the C-shaped retainer 29 to rotate, and the C-shaped retainer 29 is further retained in the recess 215 of the body 21 so that the fitting member 28 is positioned in the first chamber 212 of the body 21 to fix the limiting member 26 and the ratchet member 24, and one of the tool ends 2471 of the ratchet member 24 extends out of the second orifice 281 of the fitting member 28, due to the projection 282 of the fitting member 28 is located at the cutout 218 of the body 21, the fitting member 28 guides the contacting face 272 of the direction controlling member 27 to slide horizontally by using the guiding face 283.

Figure 6:
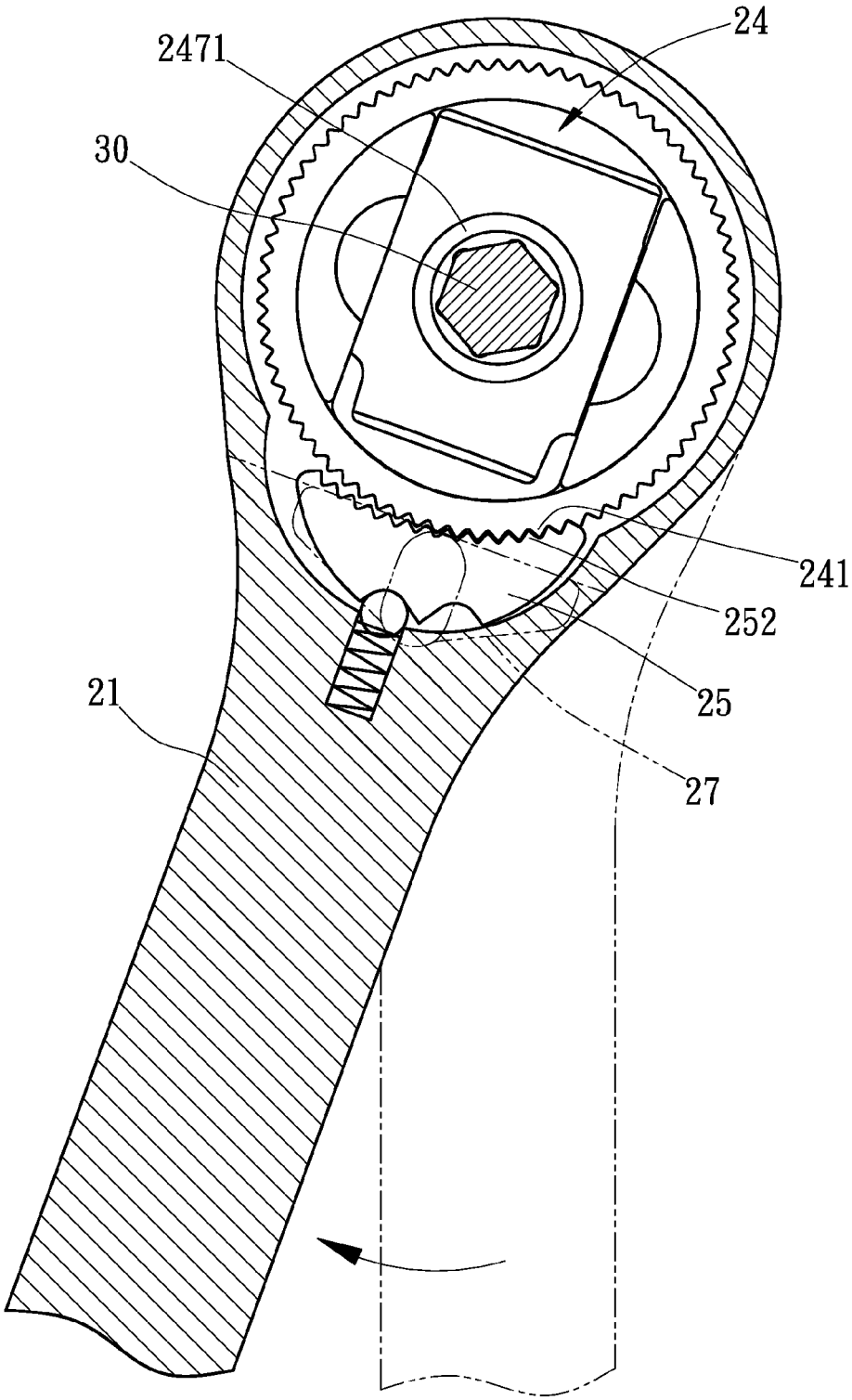
FIG. 6 is a cross sectional view showing the operation of the easy assembled ratchet wrench according to the first embodiment of the present invention.
Figure 7:
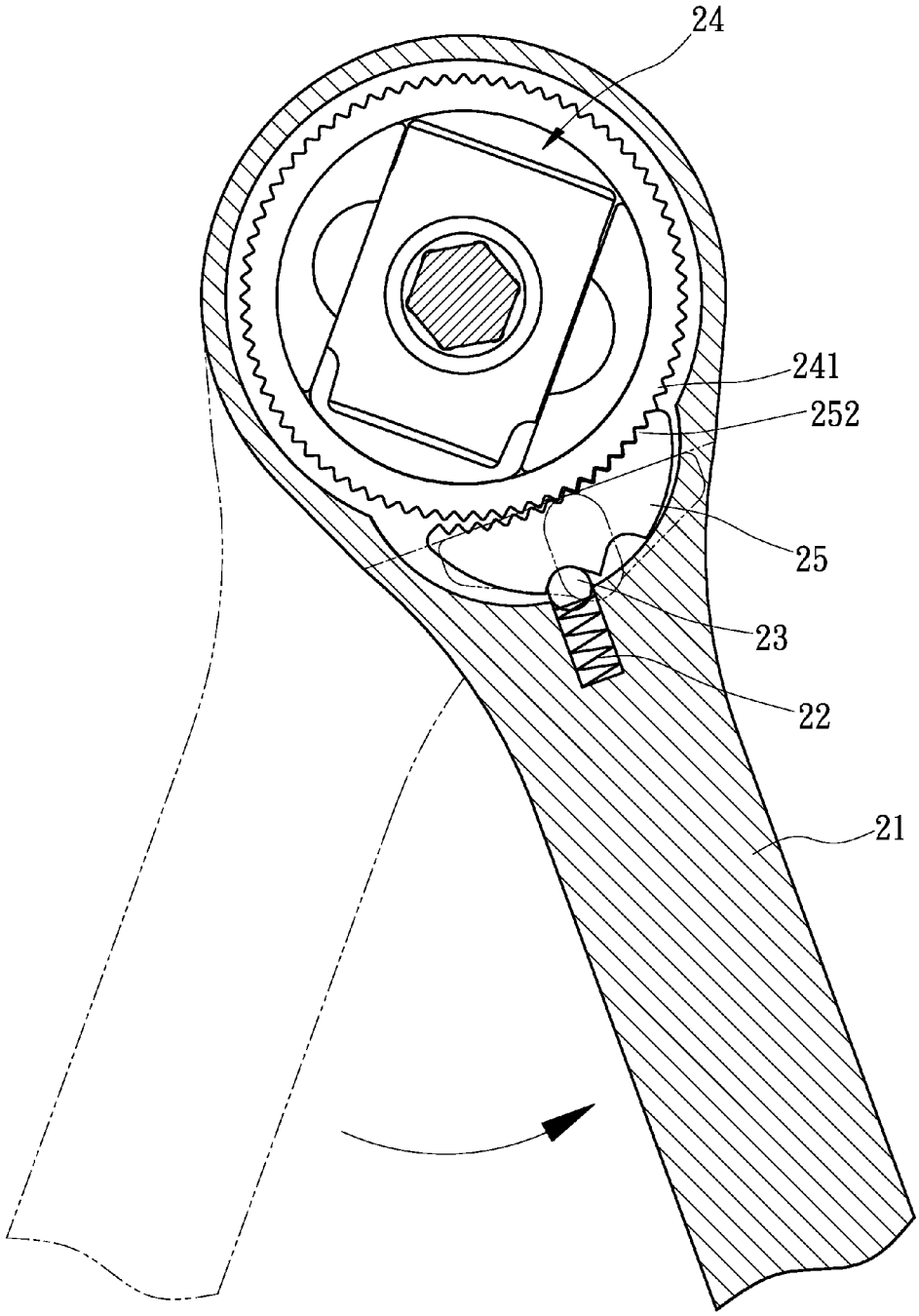
FIG. 7 is another cross sectional view showing the operation of the easy assembled ratchet wrench according to the first embodiment of the present invention.
Figure 8:
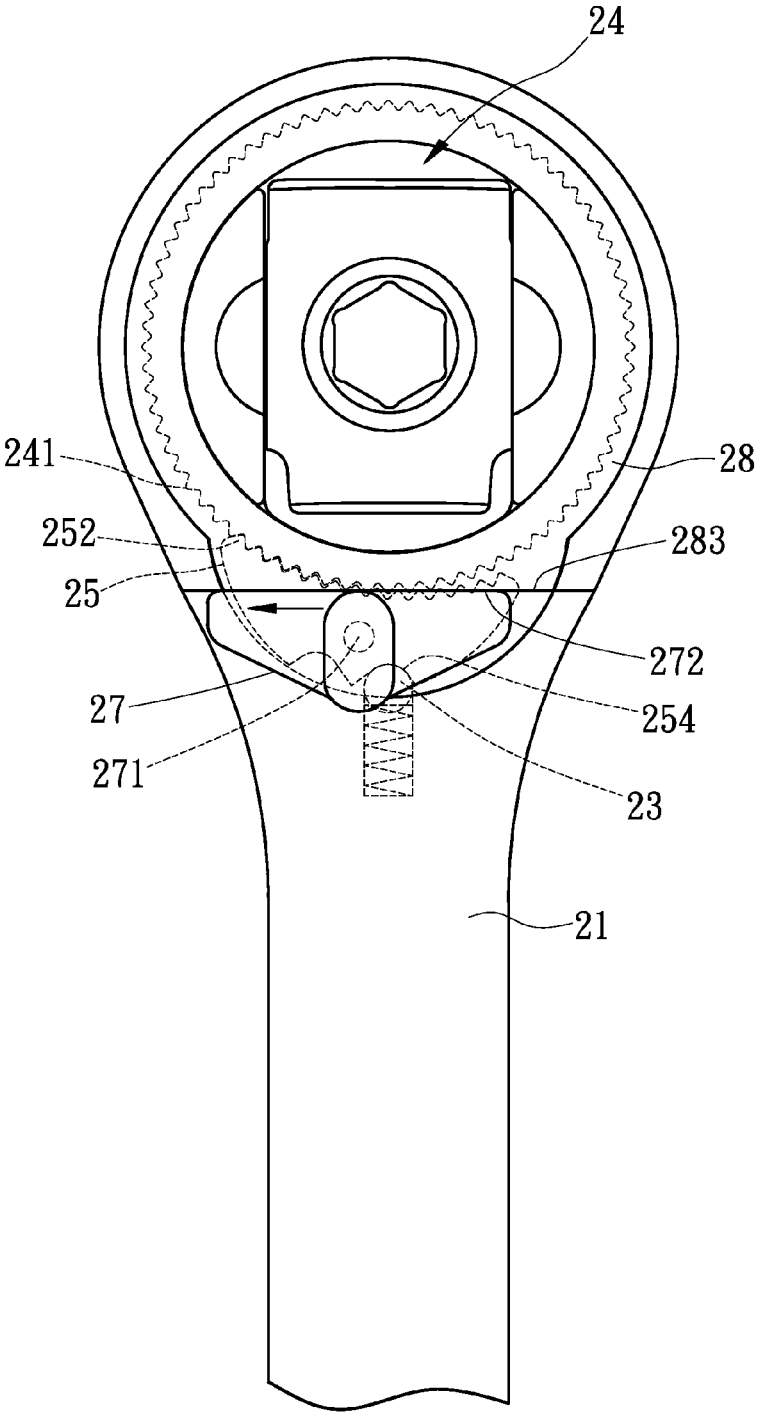
FIG. 8 is another cross sectional view showing the operation of the easy assembled ratchet wrench according to the first embodiment of the present invention.

In operation, as shown in FIG. 6, the tool end 2471 of the ratchet member 24 is fitted to a bolting member 30, since the second teeth 252 of the engaging member 25 engage with the first teeth 241 of the ratchet member 24, when the body 21 is operated to rotate in a clockwise direction, the engaging member 25 drives the ratchet member 24 to rotate so that the tool end 2471 of the ratchet member 24 actuates the bolting member 30 to rotate, thus locking a workpiece. As illustrated in FIG. 7, as desiring to adjusting a forcing angle of the body 21, the body 21 is rotated in an anti-clockwise direction, and the engaging member 25 is pushed by the first teeth 241 of the ratchet member 24 to return back to an original position, and then the steel ball 23 and the first spring 22 are pressed by the engaging member 25 so that the body 21 rotates idly to adjust it's faced angle. Referring to FIG. 8, as desiring to switching a forcing direction of the body 21, the direction controlling member 27 is pushed, and because the connecting face 272 of the direction controlling member 27 contacts with the guiding face 283 of the fitting member 28, the contacting face 272 of the direction controlling 27 displaces horizontally along the guiding face 283 of the fitting member 28, and the stem 271 actuates the engaging member 25 to move so that the second fixing portion 254 of the engaging member 25 is pushed by the steel ball 23, then the second teeth 252 of the engaging member 25 engage with the first teeth 241 of the ratchet member 24, thereby switching the forcing direction of the body 21.

Figure 9:
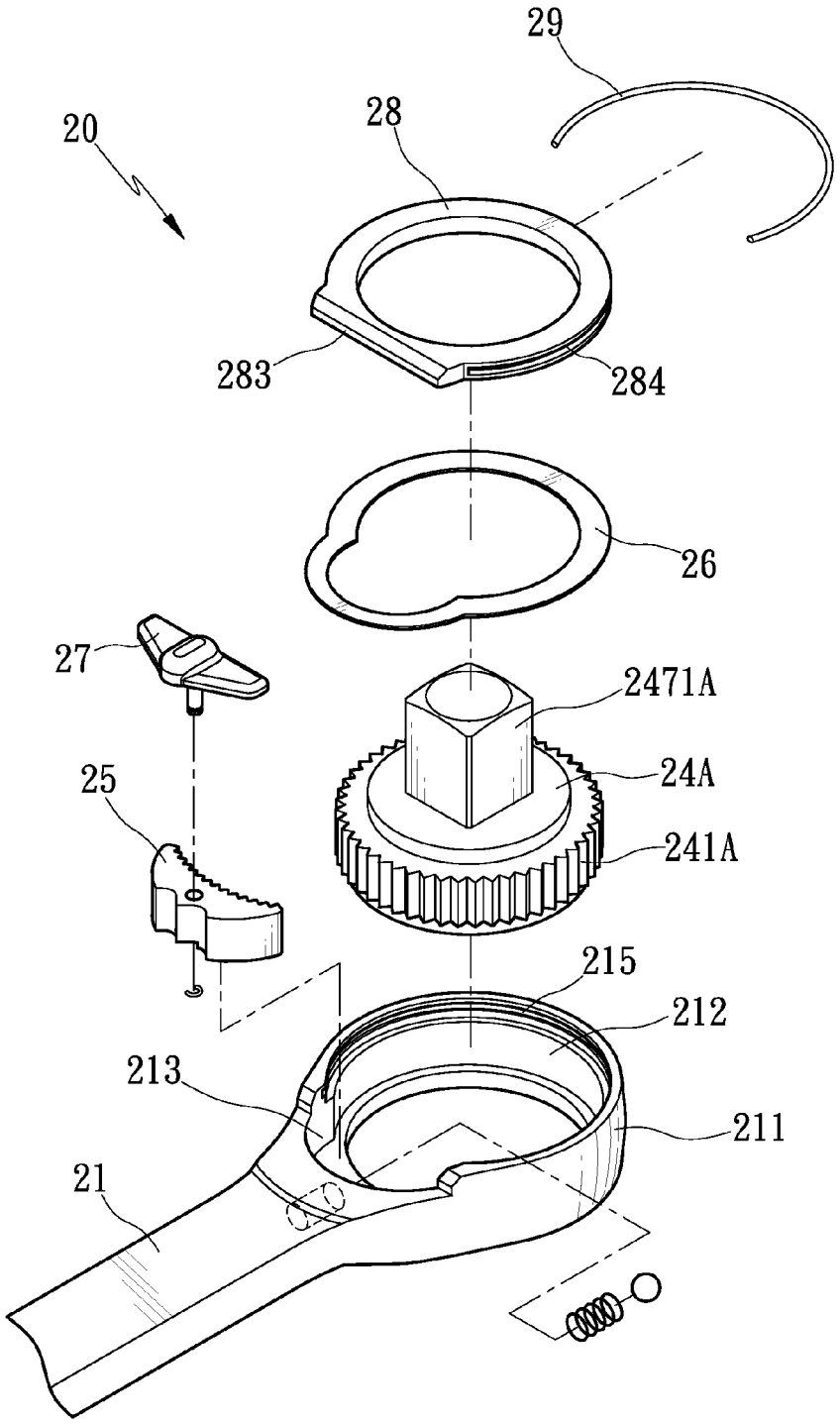
FIG. 9 is a perspective view showing the exploded components of an easy assembled ratchet wrench according to a second embodiment of the present invention.

With reference to FIG. 9, an easy assembled ratchet wrench according to a second embodiment of the present invention comprises a body 20 including a head portion 211, and the head portion 211 includes a first chamber 212 to receive a ratchet member 24A, the ratchet member 24A includes a plurality of first teeth 241 disposed around an outer wall thereof and at least one tool end 2471A, wherein the tool end 2471A is a polygonal column to fit with a socket, a second chamber 213 of the head portion 211 of the body 20 is provided to receive an engaging member 25 connecting with a direction controlling member 27, and top ends of the ratchet member 24A and the engaging member 25 include a limiting member 26 defined thereon, an indent 284 of the fitting member 28 is used to receive a C-shaped retainer 29 retained in a recess 215 of the body 20 so that the fitting member 28 is fixed in the first chamber 212 of the body 20 to prevent the ratchet member 24A from disengagement, and a guiding face 283 of the fitting member 28 guides the direction controlling member 27 to displace horizontally so that the direction controlling member 27 drives the engaging member 25 to move, thereby switching a forcing direction.

Figure 10:
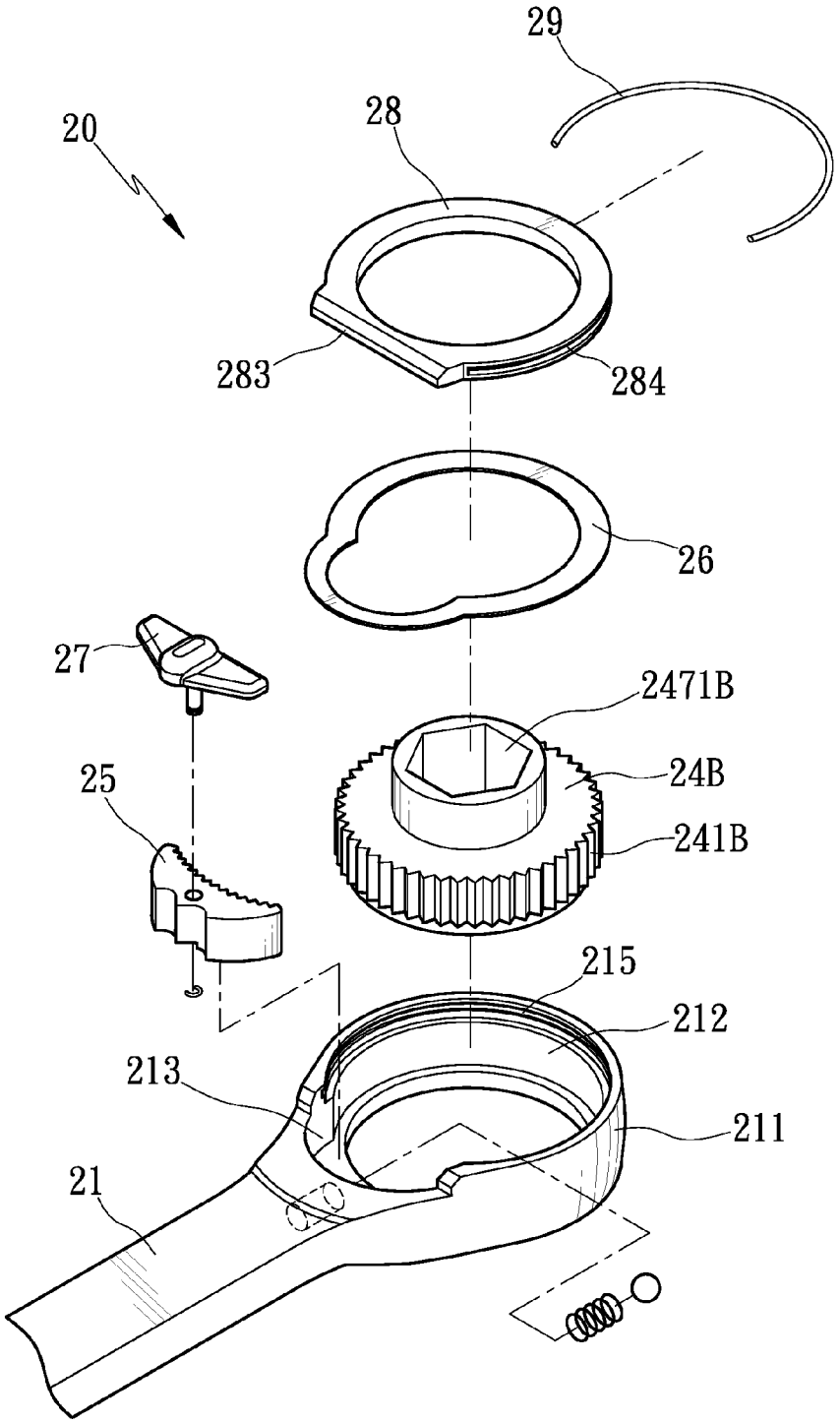
FIG. 10 is a perspective view showing the exploded components of an easy assembled ratchet wrench according to a third embodiment of the present invention.

Referring to FIG. 10, an easy assembled ratchet wrench according to a third embodiment of the present invention comprises a body 20 including a head portion 211, and the head portion 211 includes a first chamber 212 to receive a ratchet member 24B having a plurality of first teeth 241B formed around an outer surface of the ratchet member 24B, the ratchet member 24B includes at least one tool head 2471B having on hexagonal bore to fit with a bit or a bolt, the head portion 211 of the body 20 also includes a second chamber 213 to receive an engaging member 25 connecting with a direction controlling member 27, and top ends of the ratchet member 24B and the engaging member 25 include a limiting member 26 defined thereof, an indent 284 of the fitting member 28 is used to receive a C-shaped retainer 29 retained in a recess 215 of the body 20 so that the fitting member 28 is fixed in the first chamber 212 of the body 20 to prevent the ratchet member 24B from disengagement, and a guiding face 283 of the fitting member 28 guides the direction controlling member 27 to displace horizontally so that the direction controlling member 27 drives the engaging member 25 to move, thereby switching a forcing direction.

The invention is not limited to the above embodiment but various modifications thereof may be made. It will be understood by those skilled in the art that various changes in form and detail may made without departing from the scope and spirit of the present invention.

What is claimed is:

1. An easy assembled ratchet wrench comprising:

a body having a head portion disposed on at least one end thereof, and said head portion having a first chamber and a second chamber, said first chamber having a recess formed around an inner wall thereof;

a ratchet member, which is received in said first chamber of said body, comprising a plurality of first teeth arranged around an outer wall thereof and at least one tool end;

an engaging member, which is placed in said second chamber of said body, comprising a number of second teeth fixed on one surface thereof in response to said first teeth of said ratchet member;

a direction controlling member, which is inserted into said engaging member to push said engaging member, comprising a contacting face fixed on one side surface thereof;

a fitting member, which is fixed in said first chamber of said body, comprising a guiding face formed on one side thereof in response to said contacting face of said direction controlling member so that said guiding face guides said direction controlling member to displace horizontally and including an indent fixed on an outer wall thereof; and a retaining element retained in said indent of said fitting member and said recess of said body to position said fitting member; wherein said head portion of said body has a cutout disposed on a top surface thereof in response to said second chamber, said guiding face of said fitting member with a projection formed on said one side thereof in response to said contacting face of said direction controlling member, and said projection is located at said cutout of said body, wherein said guiding face is flat, and said indent includes two stop faces attached on two ends thereof respectively.

2. The easy assembled ratchet wrench, as recited in claim 1, wherein said first chamber of said body includes a port formed on a bottom end thereof, and said second chamber includes an aperture arranged on an inner wall thereof to receive a first resilient element and an abutting element, wherein said engaging member includes a first fixing portion and a second fixing portion attached on one side thereof.

3. The easy assembled ratchet wrench, as recited in claim 2, wherein said resilient element is a first spring and said abutting element is a steel ball.

4. The easy assembled ratchet wrench, as recited in claim 1, wherein said first chamber of said body includes a stepped shoulder fixed adjacent to a top end of an inner wall thereof, and a limiting member having an opening coupled at said stepped shoulder to limit said ratchet member and said engaging member, wherein said fitting member is positioned in said first chamber of said body to fix said limiting member and said ratchet member, and said tool end of said ratchet member extends out of a second orifice of said fitting member.

5. The easy assembled ratchet wrench, as recited in claim 1, wherein said head portion of said body includes a receiving segment disposed on a top surface thereof in response to said second chamber to receive said direction controlling member.

6. The easy assembled ratchet wrench, as recited in claim 1, wherein said tool end of said ratchet member is formed by selecting from a polygonal bore of a bolt and a polygonal column of a socket.

7. The easy assembled ratchet wrench, as recited in claim 1, wherein said engaging member includes a first orifice, and said direction controlling member includes a stem to be inserted into said first orifice of said engaging member.

8. The easy assembled ratchet wrench, as recited in claim 1, wherein said retaining element is a C-shaped retainer.

* * * * *